US007789692B2

(12) United States Patent
Lee

(10) Patent No.: US 7,789,692 B2
(45) Date of Patent: Sep. 7, 2010

(54) CARD EDGE CONNECTOR

(75) Inventor: Daw Wei Lee, Singapore (SG)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 12/581,988

(22) Filed: Oct. 20, 2009

(65) Prior Publication Data

US 2010/0099291 A1 Apr. 22, 2010

(30) Foreign Application Priority Data

Oct. 21, 2008 (SG) ..... 200807840-4

(51) Int. Cl.
*H01R 13/62* (2006.01)

(52) U.S. Cl. ..... 439/327; 439/328

(58) Field of Classification Search ..... 439/237, 439/238

See application file for complete search history.

(56) References Cited

U.S. PATENT DOCUMENTS 5,632,640 A * 5/1997 Noda ..... 439/326
6,276,951 B1 * 8/2001 Chen et al. ..... 439/327
6,743,028 B2 * 6/2004 Wang ..... 439/92
7,074,067 B2 * 7/2006 Yang et al. ..... 439/326

* cited by examiner

*Primary Examiner*—Tho D Ta
(74) *Attorney, Agent, or Firm*—Stephen L. Sheldon

(57) ABSTRACT

A card edge connector comprises an insulating housing comprising a receptacle provided with a plurality of terminals therein and a pair of support arms disposed at opposite ends of the insulating housing. Each of the support arms comprises a flexible portion having a distal free end. The flexible portion comprises a latch element configured for establishing a latching engagement with the card module and a resistance provider applying a relievable resistant upward force to an improperly inserted card module and causing the flexible portion to deflect while an unusually large force is applied thereto.

26 Claims, 9 Drawing Sheets

CARD EDGE CONNECTOR

RELATED CASES

This application claims priority to Singapore Application No. 200807840-4 filed Oct. 21, 2008.

BACKGROUND OF THE INVENTION

The present invention relates to electrical connectors, and more particularly, to a card edge connector with a relievable resistance provider for preventing improper insertion.

DESCRIPTION OF THE RELATED ART

Many electronic apparatus can accept extension cards to extend their capability. For example, memory cards can be installed in computer systems to support large and memory-intensive scientific applications. To connect these extension cards to a printed circuit board, several types of connectors have been developed, and a card edge connector using latches for securing installed cards is one of the most common.

U.S. patent publication no. 2007/0,270,011, entitled CARD EDGE CONNECTOR, filed May 8, 2007, by Yi-Tse Ho et al., for example, discloses a card edge connector allowing insertion of an electric card. The disclosed card edge connector includes an insulating body, a plurality of terminals, and two metallic pieces; each of the two metallic pieces 100 includes an elastic arm 102, a guiding portion 104, an engaging portion 106, a locking portion 108, and a supporting portion 110, as shown in FIG. 1. The engaging portion 106 is used to engage with its corresponding notch of the electric card in order to prevent the electric card from being pulled out of the card edge connector. The locking portion 108 is a curved bent plate, which is used for latching the electric card. Both the engaging portion 106 and the locking portion 108 are integrally formed with the elastic arm 102. When an electric card is installed incorrectly, the engaging portion 106 will not move into the corresponding notch, and as a result the elastic arm 102 is caused to deflect. This deflection is usually small, and most users will not notice without paying close attention. The deflected elastic arm 102 indicates that the electric card is not locked and latched properly, and may be released accidentally by accidentally by movement or vibration. An incorrectly installed electric card may also not function properly and may even cause damage to the whole system.

To prevent incorrect electric card installation, a fixed stop element is usually provided. The fixed stop element is normally very rigid and unmovable, and may cause damage to the card edge connector if an unusually large force is applied.

A restraint measure for elastic arms is sometimes provided. This serves to protect the elastic arm from overbending and, like the aforementioned fixed stop element, is also so rigid that damage to the card edge connector can occur.

Problems encountered with the prior art connector as described above have existed for quite some time and a solution that would help solve the above issue would be appreciated.

SUMMARY OF THE INVENTION

A card edge connector for receiving a card module is disclosed. The card edge connector can have two notches in two opposite side edges, respectively, and comprises an insulating housing including a receptacle provided with a plurality of terminals therein, for electrically and mechanically engaging with the card module, and a pair of support arms disposed at two opposite ends of the insulating housing, respectively, to form an accommodation space therebetween. The support arms can include a flexible portion having a distal free end, and the flexible portion can include a latch element extending from an upper edge of the flexible portion (which can be configured for establishing a latching engagement with a top surface of the card module while the card module is in the accommodation space). The support arm can also include a resistance provider (which can be disposed adjacent to the latch element and aligned vertically with the corresponding notch of the card module and can have an inclined surface which is inclined slightly inward and downward). The resistance provider can apply a relievable resistant upward force to an improperly inserted card module when the improperly inserted card module engages with the inclined surface while allowing the flexible portion to deflect if an unusually large force is applied to the inclined surface. Each support arm can also include and a lock element disposed in the corresponding notch, extending obliquely inward and upward from a lower edge of the flexible portion and configured to engage the corresponding notch thereof for preventing the card module from pulling out. The lock element can include a base portion that is configured for engaging a bottom corner edge of the notch. In operation, the base portion and the latch element can limit the vertical movement of the card module. In an embodiment, each support arm can comprise a flexible portion and a fixed portion placed below the flexible portion, with a latch element, a lock element disposed on the flexible portion and in the corresponding notch (configured for engaging the corresponding notch thereof for preventing the card module from pulling out), a securing element extending downward from a lower edge of the flexible portion and having a free end, and a confining element extending outward and then upward from a lower edge of the fixed portion to form a recess, wherein the free end of the securing element is confined within the recess.

BRIEF DESCRIPTION OF THE DRAWINGS

The depicted features are illustrated by way of example and not limited in the accompanying figures in which.

DETAILED DESCRIPTION OF THE INVENTION

Figure 1:
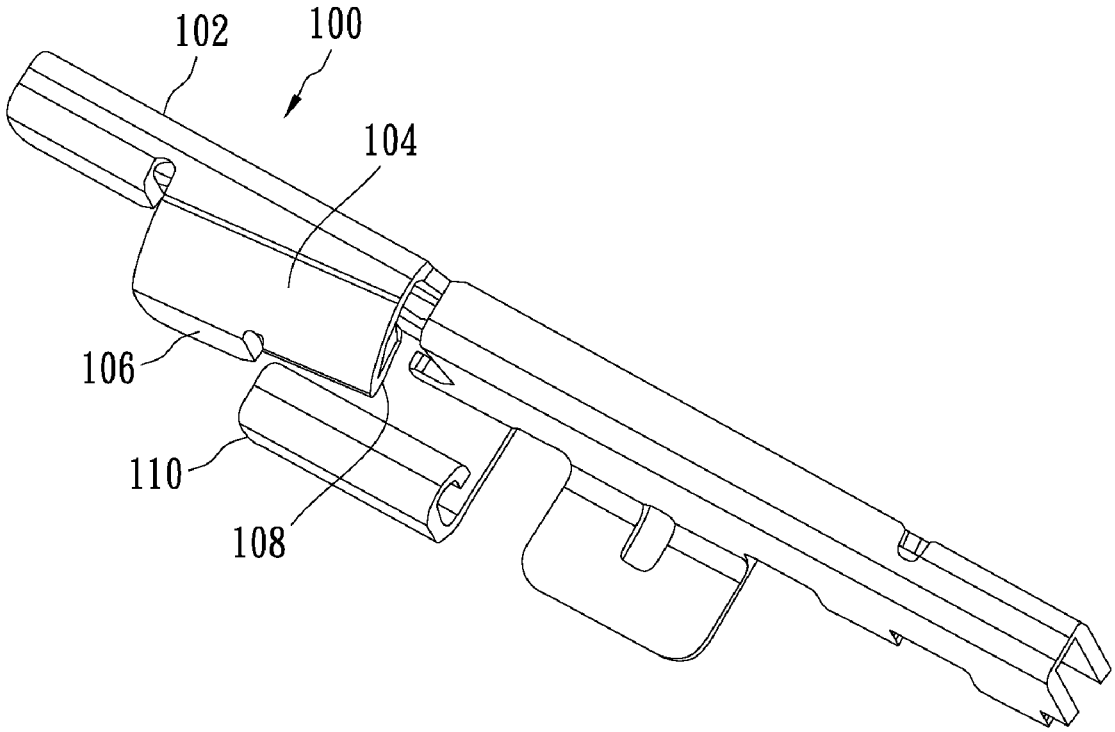
FIG. 1 illustrates a view of a metallic piece of a prior art connector.

Referring to FIGS. 2-5, a card edge connector 200 in accordance with one embodiment comprises an elongated insulating housing 202 and a pair of support arms 204 disposed at two opposite ends 210 of the insulating housing 202. The support arms 204, extending horizontally along a printed circuit board 212, form an accommodation space for accommodating a card module (not shown) therebetween. The insulating housing 202 comprises an elongated receptacle 206, disposed therein along the elongated direction, used for adopting the card module (not shown). A plurality of terminals 208, 301 for electrically and mechanically engaging with the card module (not shown) are provided in pairs on the upper and lower inner surfaces of the receptacle 206 along the elongated direction. The card module (not shown) is electrically coupled to a printed circuit board 212 through the terminals 208, 301. Erected rectangular blocks 302, each of which has an indentation 304, are disposed at both ends of the insulating housing 202, respectively, and each corresponds in size and shape to its mated rail-like portion 306 disposed at one end of the support arm 204. The indentation 304 provided for the corresponding locking member 308 of the support arm 204 is used for securing and positioning the support arm 204. In one embodiment, the insulating housing 202 can be made of plastic materials.

Each of the terminals 208, 301 has a head portion 310, 310' and a tail portion 312, 312'. The head portions 310 are inserted in slots 214, which are arrayed along the elongated direction of the insulating housing 202, located on the lower inner surface and closed to the card insertion entrance of the receptacle 206, and the contact parts 314 thereof protrude upward in the receptacle 206. The head portions 310' are inserted, from the side opposite the card insertion entrance, in slots (not shown) which are arrayed along the elongated direction of the insulating housing 202 and located on the inner upper surface of the receptacle 206, and the contact parts 314' thereof protrude downward in the receptacle 206. The contact parts 314 and 314' are used for electrically and mechanically engaging with the terminals on the card module. The contact parts 314 and 314' are staggered vertically so as to cause the card module to insert obliquely. The tail portions 312, 312' extend across the insulating housing 202 and connect to the corresponding contacts 216 on the printed circuit board 212.

Each of the support arms 204 is made of a plate-like material and comprises a rail-like portion 306, a fixed portion 218 and a flexible portion 220. In the present embodiment, the support arms 204 are made of metals, and can be formed integrally by pressing process. The rail-like portion 306 has two U-shaped parts 316 extending inward from the upper edge 404 and lower edge 406 of the support arms 204 separately. The locking member 308 formed in the rail-like portion 306 is a plate-like locking member 308 having a forward free end 408 positioned inward. The fixed portion 218 and the flexible portion 220 are disposed in parallel, on the same side edge of the rail-like portion 306.

Figure 2:
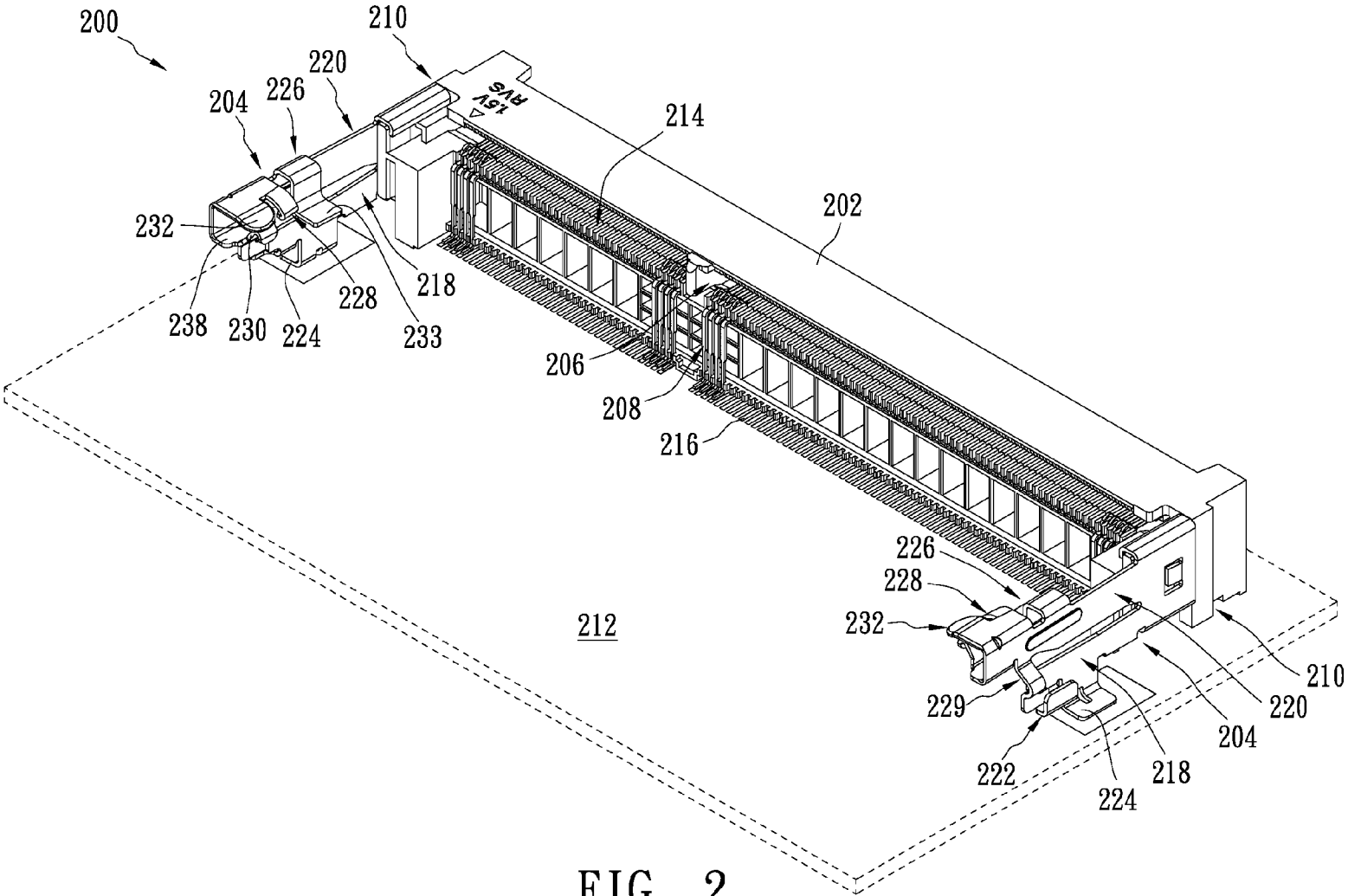
FIG. 2 illustrates a perspective view of an embodiment of a card edge connector.
Figure 3:
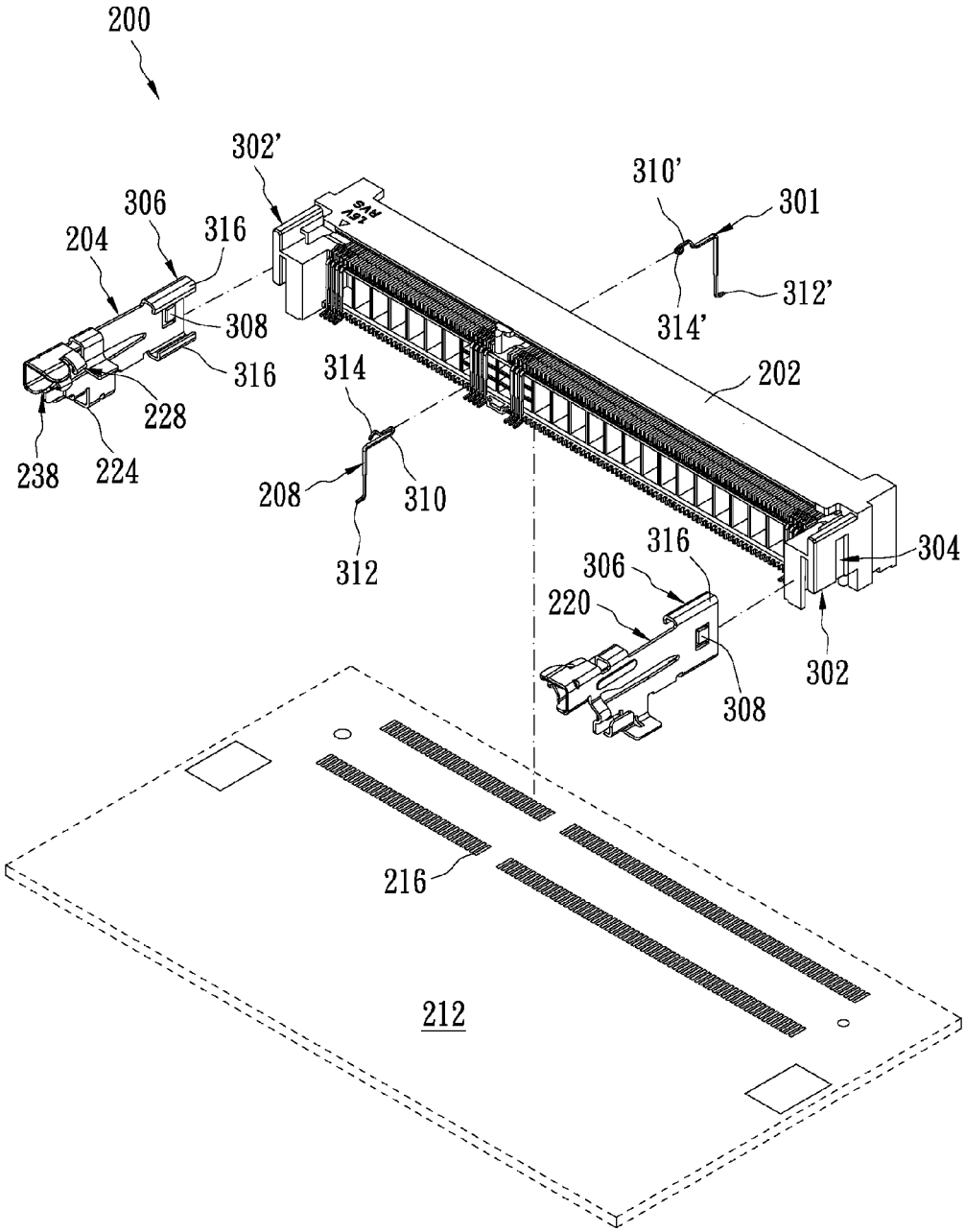
FIG. 3 illustrates an exploded perspective view of an embodiment of a card edge connector.
Figure 4:
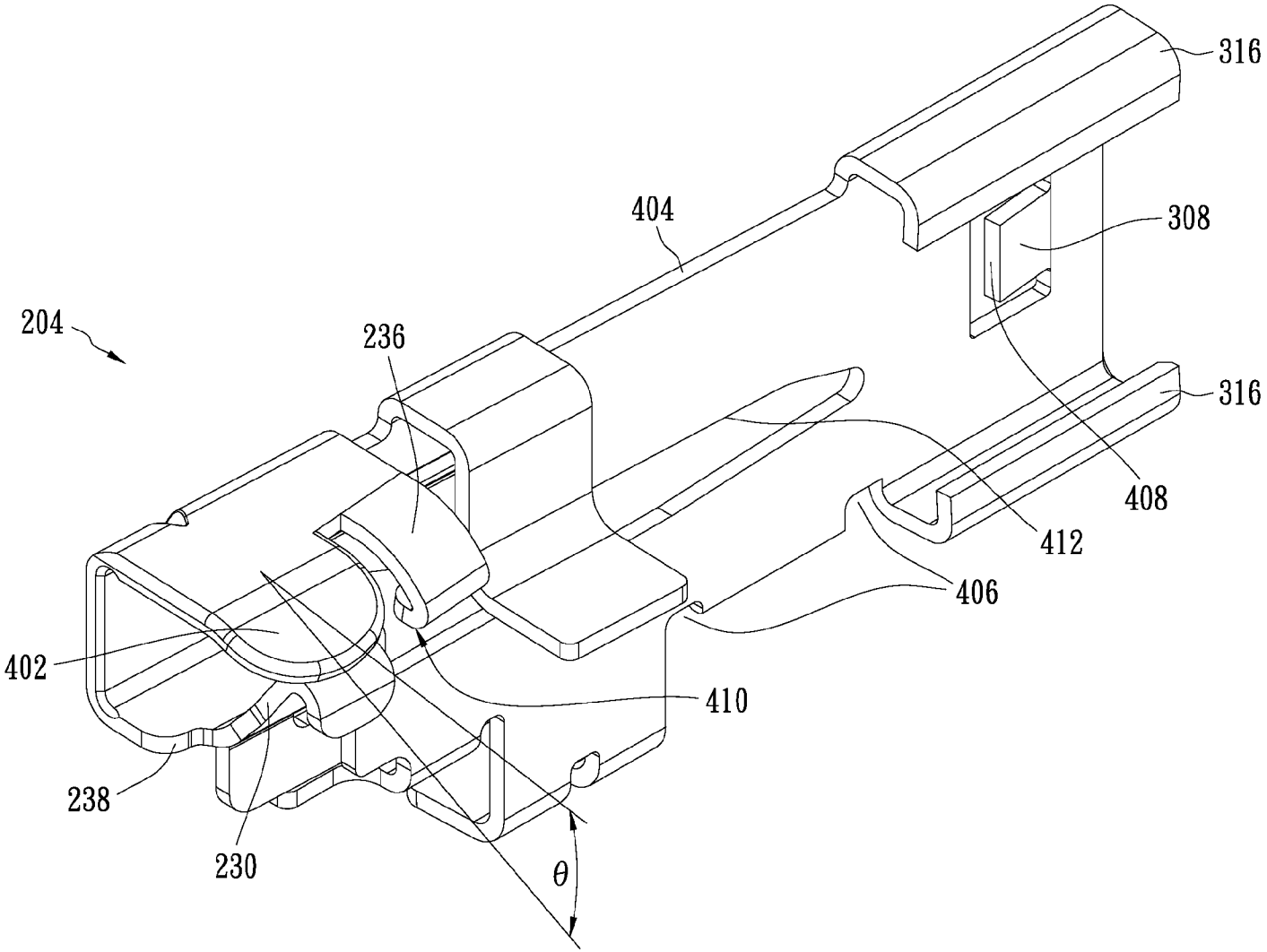
FIG. 4 illustrates a perspective view of an inner side of an embodiment of a support arm.
Figure 5:
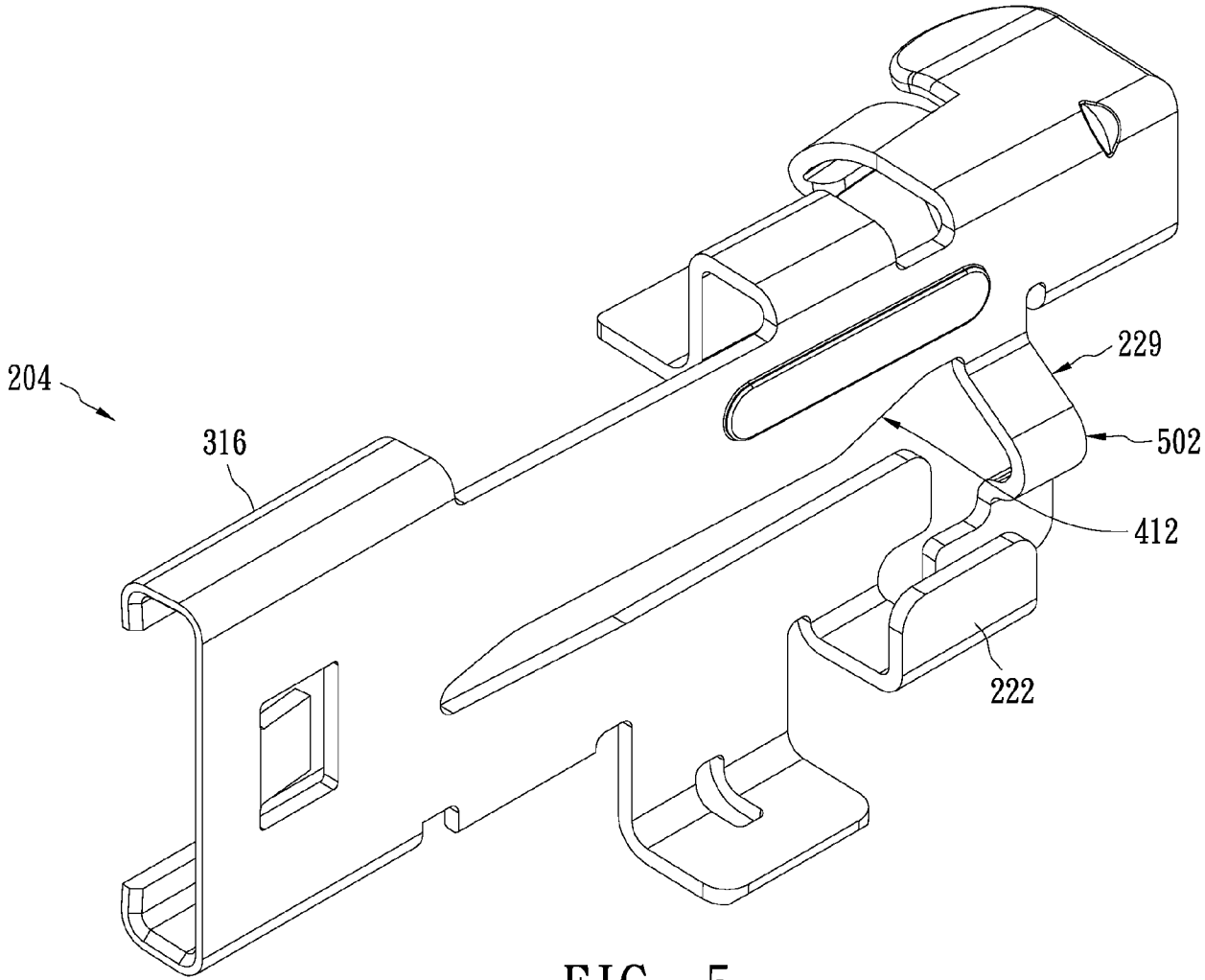
FIG. 5 shows a perspective view of an outer side of an embodiment of a support arm.

The fixed portion 218 comprises a confining element 222 and a fixture element 224. The confining element 222, closed to the end of the fixed portion 218 and extending from the lower edge 406 of the support arm 204 (or the fixed portion 218), has a U-shaped cross section. The fixture element 224 extending from the lower edge 406 of the support arm 204 (or the fixed portion 218) downward and then outward is configured for mounting the card edge connector 200 firmly on the printed circuit board 212 by screwing, welding, soldering or the like (as shown in FIG. 2).

The flexible portion 220, having a distal free end, comprises a support element 226, a latch element 228, a securing element 229, a lock element 230 and a resistance provider 232. The support element 226 extending from the upper edge 404 of the support arm 204 is bent at right angles inward, then downward, and then inward (i.e., bent into a right-angle Z-shaped form) to provide a holding plate 233, which engages the bottom side of the card module and provides support for the card module. The latch element 228 extends inward and downward in a curved manner from the upper edge 404 to form a curved surface 236, and then outward to form a retaining portion 410. The curved surface 236 configured for engaging the corresponding bottom edge corner and side edge of the card module is used to deflect the corresponding flexible portion 220 outward and to move all the inward-extending portions out of the insertion path of the card module, and also enables a low insertion force. The retaining portion 410 is configured for engaging the corresponding top surface of the card module, whereby the card module is held in the accommodation space and is not ejected by the elastic contact parts 314, 314'.

The securing element 229 extends from the lower edge 412 of the flexible portion 220, and its T-shaped free end is directed downward into the confining element 222. The movement of the T-shaped free end is confined within the U-shaped recess of the confining element 222 so that the flexible portion 220 is unlikely to be overstressed by being accidentally bent inward or outward. In the present embodiment, the securing element 229 optionally has a C-shaped part 502, which can improve elasticity of the securing element 229. An elastic securing element 229 with the C-shaped part 502 resists permanent deformation when subjected to a large force.

The flexible portion 220 and the fixed portion 218 are arrayed in a lateral direction, and even without considering the C-shaped part 502, the securing element 229 extending from the lower edge 412 of the flexible portion 220 straight downward into the confining element 222 is long enough to permit elastic deformation.

The lock element 230, located at the distal free end of the flexible portion 220, extends obliquely inward and upward and thence downward from the lower edge 412 of the flexible portion 220. The lock element 230, disposed in the corresponding notch when the card module is in the accommodation space, is configured for locking or securing the card module in the accommodation space to prevent the card module from being accidentally ejected or removed. The lock element 230 has a curved tapered outline, and a wide base portion 238 can engage the bottom corner edge of the notch. Therefore, the card module in the accommodation space can be firmly held in place by the latch element 228, which presses the top surface close to the top edge, and the based portion 238, which provides support vertically to the bottom corner edge.

The resistance provider 232, projecting from the upper edge 404, has an inclined surface 402, which is inclined slightly inward and downward, and it is typically, but not necessarily, disposed adjacent to the latch element 228. The resistance provider 232 is configured for providing a relievable resistant upward force to help prevent incorrect installation of the card module, and the resistance provider 232 is relieved when an unusually large force is applied. In other words, the resistance provider 232 is attached to the flexible portion 220, which will only be deflected by application of an unusually large force thereupon. In the present embodiment, the resistance provider 232 is disposed closer to the distal free end of the flexible portion 220 than to the latch element 228.

The resistance provider 232 is aligned vertically with the corresponding notch when the card module is in the accommodation space. In other words, the resistance provider 232 is placed upright above the lock element 230.

Figure 6:
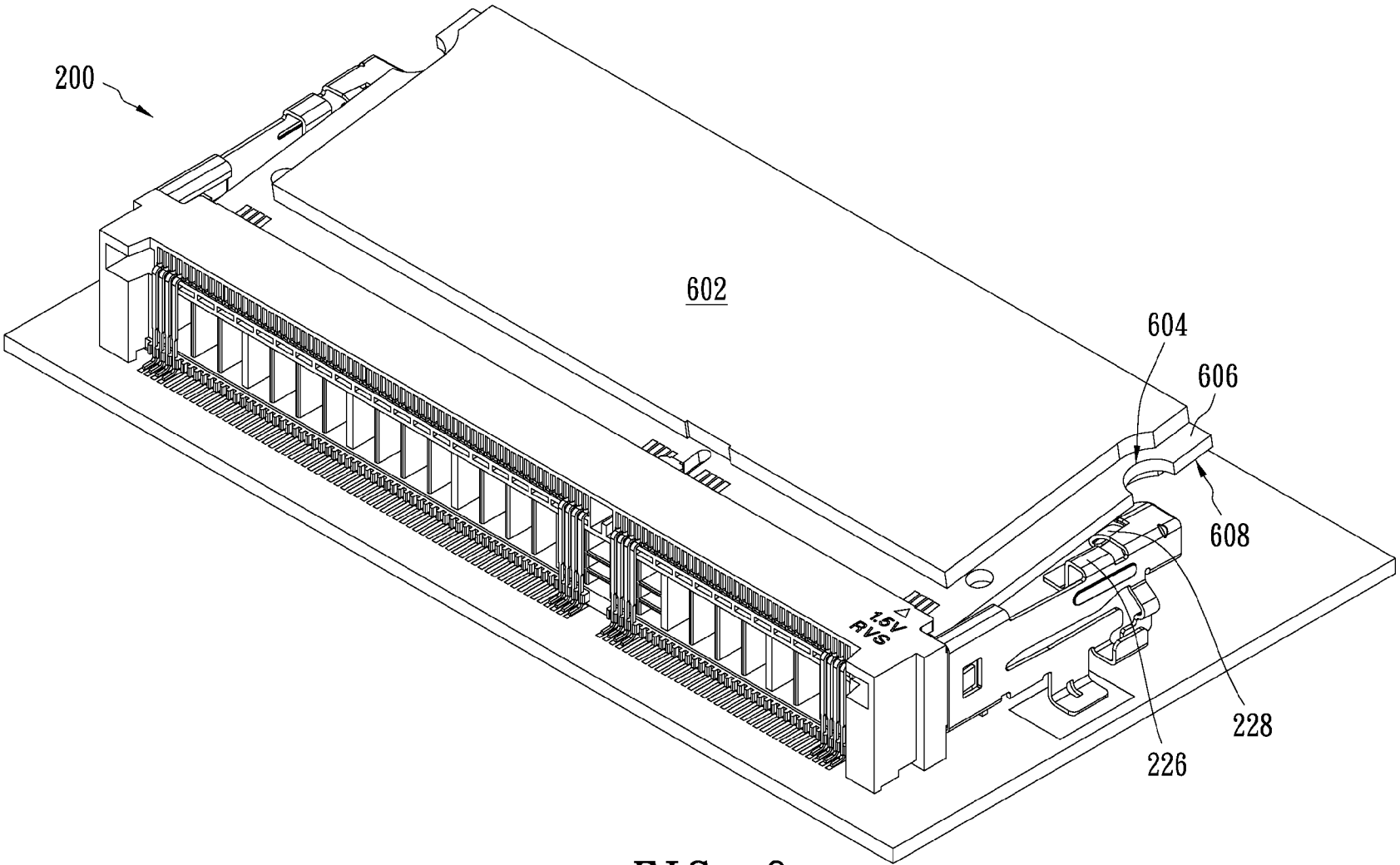
FIG. 6 shows a perspective view of a card being obliquely inserted into edge connector.

The resistance provider 232 can have a peripheral outline shape corresponding substantially to the shape of the notch 604 of the card module 602 (as shown in FIG. 6), and when the card module 602 is inserted into the receptacle 206 correctly, the resistance provider 232 can pass through the corresponding notch 604 without interference.

In one embodiment, the tip portion of the resistance provider 232 can be designed to fit into the corresponding notch 604 for enhancing the locking of the card module 602.

Figure 7:
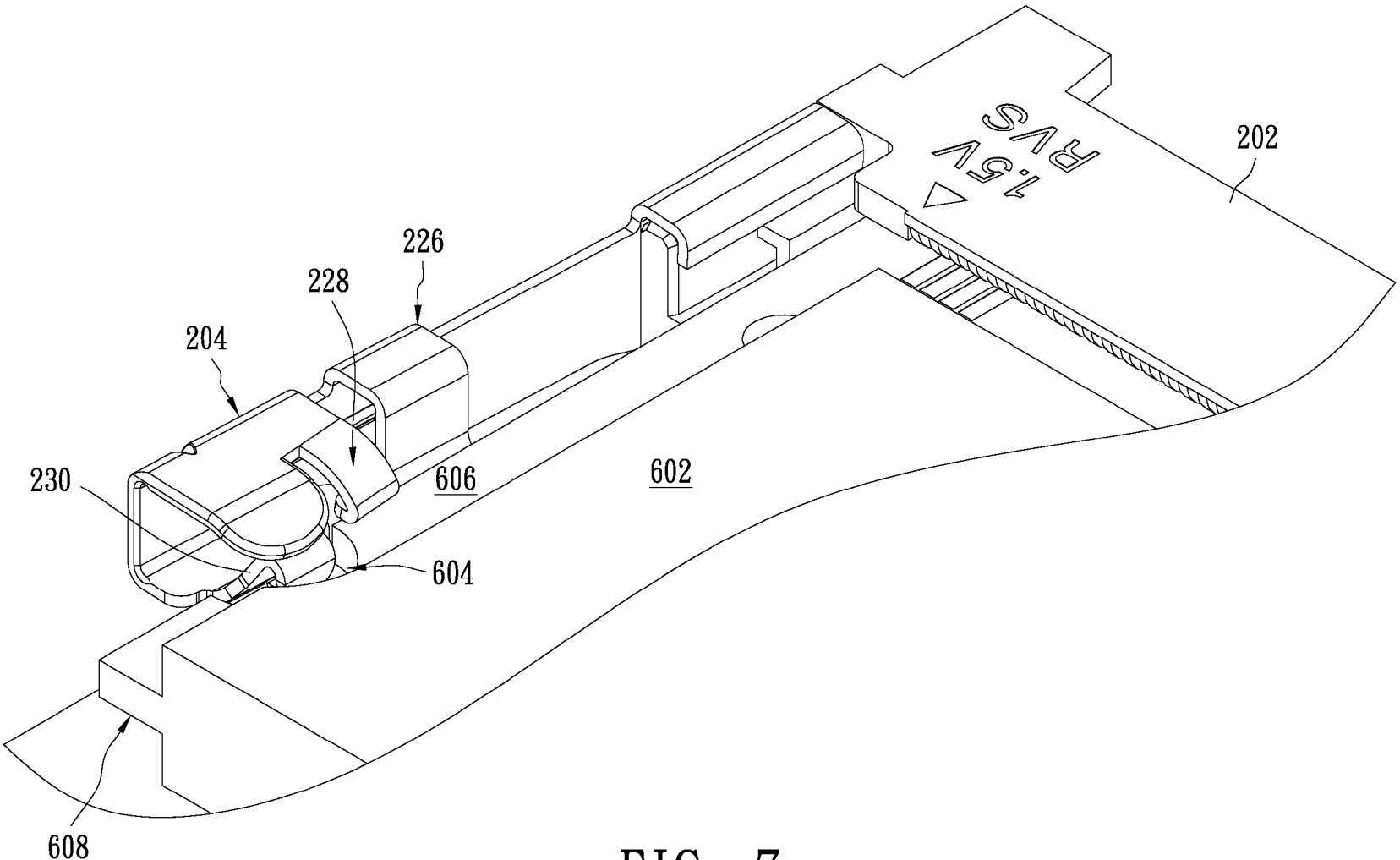
FIG. 7 illustrates a perspective view of an embodiment of an installed card module.
Figure 8:
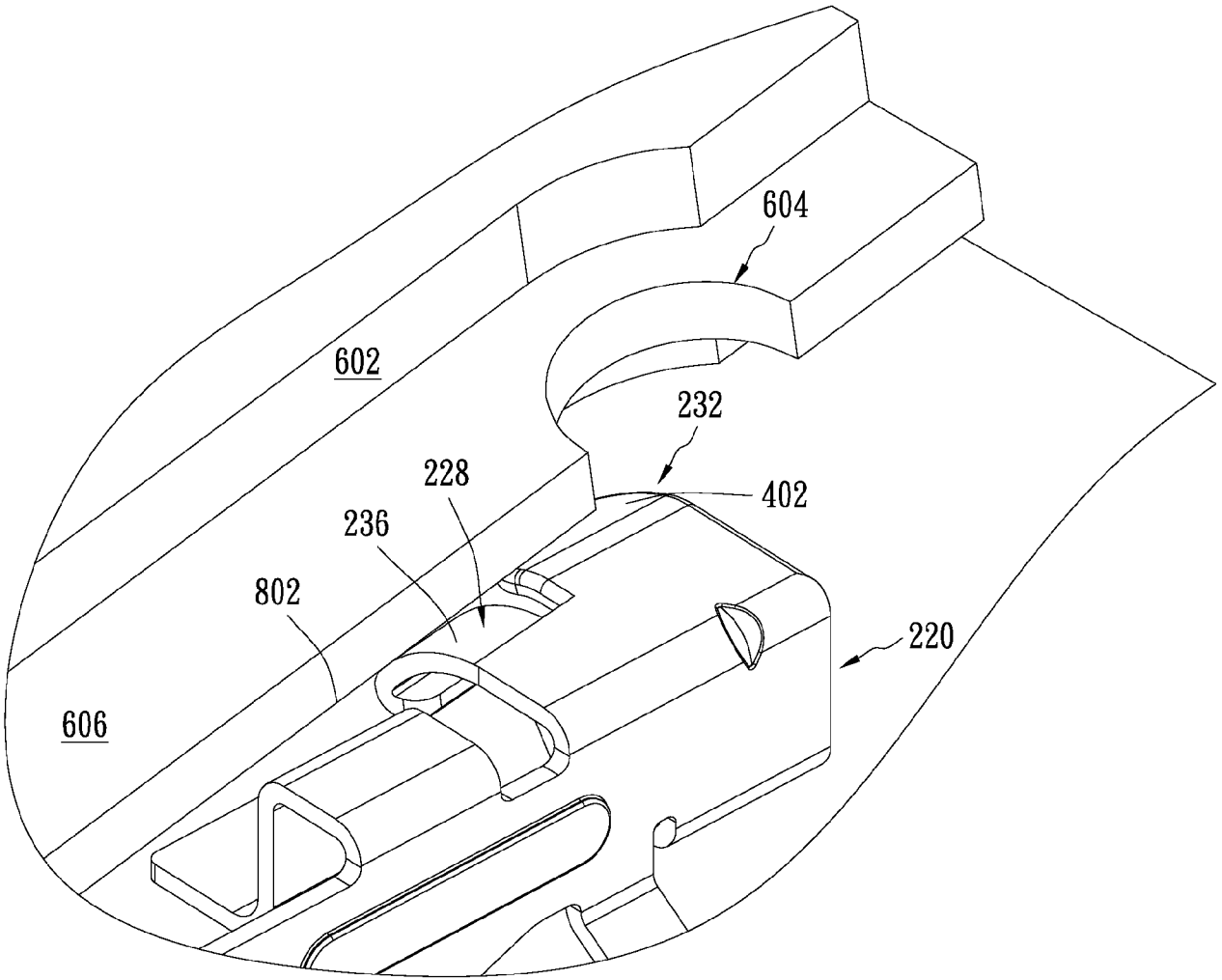
FIG. 8 illustrates an enlarged perspective view of an embodiment of a card module improperly inserted into a card edge connector.

Referring to FIG. 6-9, when a card module 602 is installed into the card edge connector 200, the card module 602 is initially inserted into the receptacle 206 obliquely (as shown in FIG. 6), and at this time the inserted elongated side engages the card edge connector 200. The card module 602 is then pressed downward to rotate. The bottom corner edge 802 starts engaging the curved surface 236 of the latch element 228 (as shown in FIG. 8), and by the engagement, the force caused by the bottom corner edge 802 and applied to the curved surface 236 pushes the flexible portion 220 outward. Because of the curved surface 236, the insertion force encounters a low resistance as the flexible portion 220 is pushed away. If the card module 602 is inserted correctly, the resistance provider 232 will be aligned vertically with the corresponding notch 604 and can pass through the notch 604 during insertion. When the card module 602 is within the accommodation space, the lock element 230 will be received by the corresponding notch 604, thereby preventing the card module 602 from being detached; the latch element 228 will engage the top surface 606 near the side edge, thereby stabilizing the inserted card module 602; and the support element 226 will engage the bottom surface 608 near the side edge, thereby preventing the card module 602 from being displaced downward (as shown in FIG. 7). However, if the card module 602 is inserted incorrectly, the resistance provider 232 will not align vertically with the corresponding notch 604 and will provide a resistance to the card module 602. During incorrect insertion, the bottom corner edge 802 will engage the curved surface 236 and push the flexible portion 220 slightly outward initially, and then engage the resistance provider 232 (as shown in FIG. 8). The resistance provider 232 has a downward-inclined surface 402 engaging the bottom corner edge 802, and from the inclined surface 402, the card module 602 encounters a resistant upward force. The resistant upward force is quite large so that the card module 602 cannot be pressed down any farther. Some users may apply an unusually large force to the card module 602 when it cannot be inserted. Under such situation, if the resistance provider 232 is rigid, the unusually large force may damage the resistance provider 232, or even the whole card edge connector 200. If there is any damage, the damaged parts of the card edge connector 200 will no longer work properly, and an improper installation of card module 602 may subsequently occur. However, the depicted design of inclined surface 402 of the resistance provider 232 not only can provide a sufficiently noticeable resistant upward force to alert a user that the card module 602 is positioned incorrectly, but also has relievable function to prevent damage to the card edge connector 200 when an unusually large force is applied. Unlike a curved surface, the flexible portion 220 cannot be moved by applying a normal installation force on the inclined surface 402. As compared to the fixed stop element of the prior art, the flexible portion 220 will be moved while an unusually large force is applied to the inclined surface 402 if the horizontally divided force component is strong enough to push the flexible portion 220 outward. The unusually large force is the force that is commonly exerted by the user after an unsuccessful attempt to install the card module 602. Such force, greater than necessary for card module installation, could be applied by some users either out of impatience or from sincere effort to successfully install a card module 602 that is perceived by the user to be difficult to install. In the present embodiment, the angle θ of the inclined surface 402 is in the range of about 5° to about 30°. Preferably, the angle of the inclined surface 402 is in the range of about 15° to about 25°.

Figure 9:
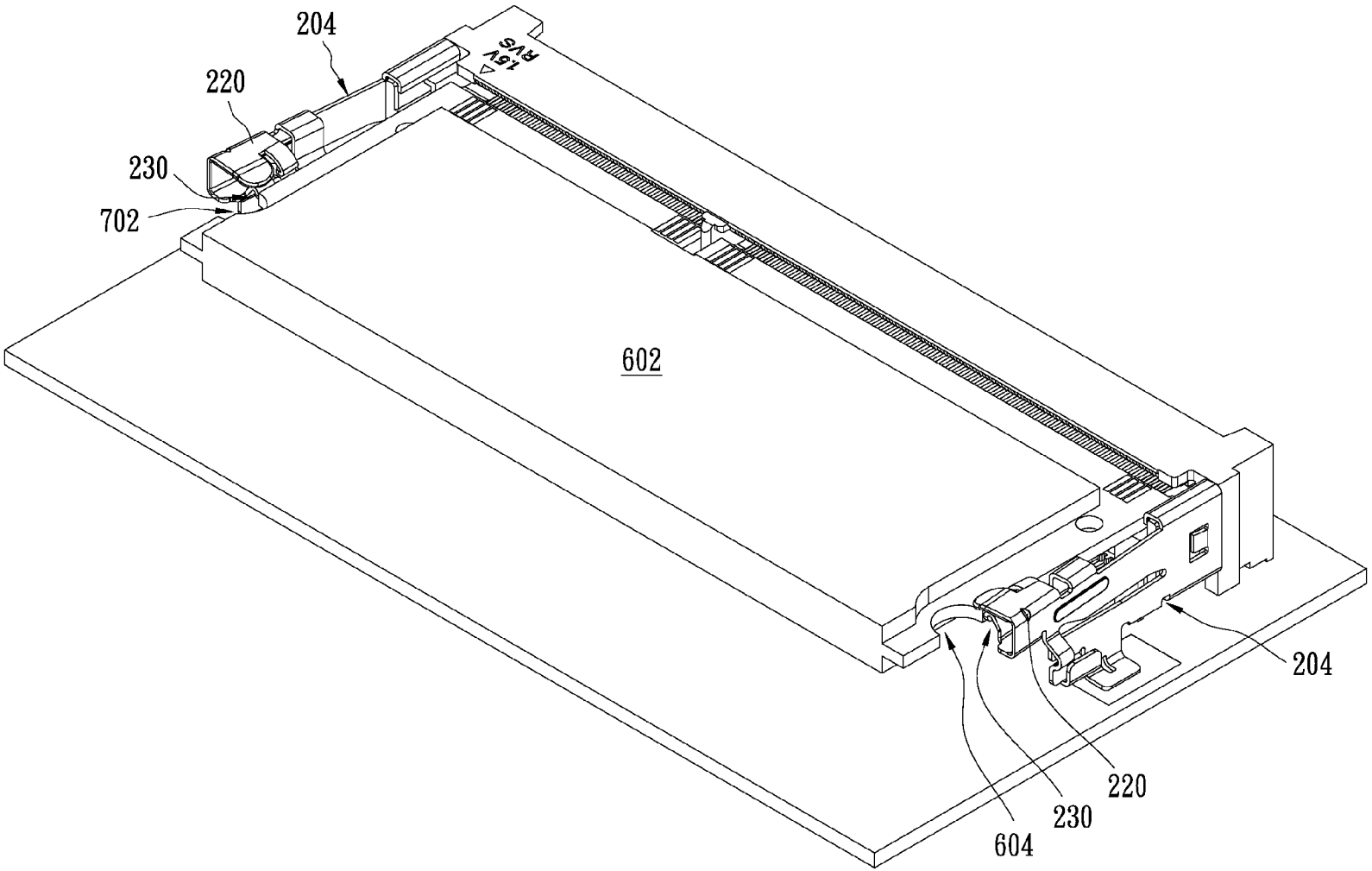
FIG. 9 illustrates is a perspective view of an embodiment of an improperly installed card module.

Referring to FIG. 9, an incorrectly positioned card module 602 is not allowed to be installed into the accommodation space of the card edge connector 200, but as mentioned above, for protection of the card module 602, the card module 602 may be improperly inserted. Because the lock element 230 of the improperly inserted card module 602 misaligns the corresponding notch 604, the flexible portion 220 is deflected, and a user can observe the deflection and understand that the installation is incorrect. Therefore, an incorrect installation can be more readily noticed and avoided.

In summary, the card edge connector 200 depicted can inhibit the installation of any incorrectly positioned card module 602 by use of a resistance provider 232 disposed on a flexible portion 220. To protect the card edge connector 200 from damage in cases of improper insertion, the resistance provider 232 can release so that the card module 602 is allowed to enter the accommodation space yet still be installed incorrectly. The flexible portion 220 will be deflected by the incorrectly installed card module 602 to let a user understand that the card module 602 is installed incorrectly. Compared to the above-mentioned prior art, which only provides elastic arms 102 to indicate improper installation but no stop means, the card edge connector 200 can provide the advantage of a resistance provider 232 which resists incorrect installation attempts but is configured so as to minimize damage to the card edge connector 200 itself if higher force levels are applied.

The above-described embodiments are intended to be illustrative only. Numerous alternative embodiments may be devised by persons skilled in the art without departing from the scope of the following claims.

What is claimed is:

1. A card edge connector, comprising:

an insulating housing with first and second opposite ends;

a plurality of terminals disposed in the housing between the ends and configured, in operation, to electrically and mechanically engaging with a card module; and a first and second support arm respectively disposed at the first and second end of the housing and configured to form an accommodation space therebetween, a flexible portion provided on a distal end of each support arm, the flexible portion having an upper portion, the flexible portion including a latch element extending from an upper edge of the flexible portion and configured, in operation to establish a latching engagement with a top surface of the card module when the card module is positioned in the accommodation space; and a resistance provider disposed adjacent to the latch element and configured to be aligned vertically with a corresponding notch of the card module, the resistance provider having a surface which is inclined inward and slightly downward, wherein the resistance provider is configured to resistant insertion of an incorrectly aligned card module engages with the inclined surface and is further configured to causes the flexible portion to deflect while an unusually large force is applied to the inclined surface.

2. The card edge connector of claim 1, wherein a peripheral outline shape of the resistance provider corresponds substantially to a shape of the notch.

3. The card edge connector of claim 1, wherein the resistance provider is above the top surface of the card module.

4. The card edge connector of claim 1, wherein the resistance provider projects from the upper edge of the flexible portion.

5. The card edge connector of claim 1, wherein a tip portion of the resistance provider is positioned in the corresponding notch thereof when the card module is in the accommodation space.

6. The card edge connector of claim 1, wherein the latch element extends in a curved manner inward and downward from the upper edge of the flexible portion to form a curved surface for causing the flexible portion to deflect outward when the card module is being inserted into the accommodation space, and thence outward to form a retaining portion for engaging the top surface of the card module.

7. The card edge connector of claim 1, wherein the resistance provider is closer to the distal free end than to the latch element.

8. The card edge connector of claim 1, wherein the flexible portion further comprises a support element, which extends from the upper edge of the flexible portion and is of a right-angle Z-shaped form, for engaging a bottom side of the card module for supporting the card module in the accommodation space.

9. The card edge connector of claim 1, wherein the angle of the inclined surface is in a range of about 15° to about 30°.

10. A card edge connector for receiving a card module having two notches in two opposite side edges respectively, comprising:

an insulating housing comprising a receptacle provided with a plurality of terminals therein for electrically and mechanically engaging with the card module; and a pair of support arms disposed at opposite ends of the insulating housing to form an accommodation space therebetween, each of the support arms comprising a flexible portion having a distal free end, and the flexible portion comprising:

a latch element extending from an upper edge of the flexible portion and configured for establishing a latching engagement with a top surface of the card module when the card module is in the accommodation space; and a lock element extending obliquely inward and upward from a lower edge of the flexible portion and configured to engage the corresponding notch thereof for preventing the card module from pulling out, the lock element having a base portion, the base portion configured for engaging a bottom corner edge of the notch;

wherein the base portion and the latch element limit the vertical movement of the card module.

11. The card edge connector of claim 10, wherein the flexible portion further comprises a resistance provider aligned vertically with the corresponding notch, the resistance provider has a peripheral outline shape corresponding substantially to a shape of the notch and an inclined surface, which is inclined slightly inward and downward, and the resistance provider applies a relievable resistant upward force when an improperly inserted card module engages with the inclined surface, and causes the flexible portion to deflect while an unusually large force is applied to the inclined surface.

12. The card edge connector of claim 11, wherein the resistance provider is above the top surface of the card module.

13. The card edge connector of claim 11, wherein a tip portion of the resistance provider is positioned in the corresponding notch thereof.

14. The card edge connector of claim 10, wherein the resistance provider projects from the upper edge of the flexible portion.

15. The card edge connector of claim 10, wherein the angle of the inclined surface is in a range of about 5° to about 30°.

16. The card edge connector of claim 15, wherein the angle of the inclined surface is in a range of about 15° to about 25°.

17. The card edge connector of claim 10, wherein the latch element extends in a curved manner inward and downward from the upper edge of the flexible portion to form a curved surface for causing the flexible portion to deflect outward when the card module is being inserted into the accommodation space, and thence outward to form a retaining portion for engaging the top surface of the card module.

18. The card edge connector of claim 10, wherein the flexible portion further comprises a support element, which extends from the upper edge of the flexible portion and is of a right-angle Z-shaped form, for engaging a bottom side of the card module for supporting the card module in the accommodation space.

19. A card edge connector for receiving a card module having two notches in opposite side edges, the connector comprising:

an insulating housing including a receptacle provided with a plurality of terminals therein for electrically and mechanically engaging with the card module; and a pair of support arms disposed at opposite ends of the insulating housing to form an accommodation space therebetween, wherein each of the support arms comprises a flexible portion and a fixed portion placed below the flexible portion, the support arm comprising:

a latch element extending from an upper edge of the flexible portion and configured for establishing a latching engagement with a top surface of the card module when the card module is in the accommodation space;

a lock element disposed on the flexible portion and configured to engage the corresponding notch thereof for preventing the card module from pulling out;

a securing element extending downward from a lower edge of the flexible portion and having a free end; and a confining element extending outward and then upward from the lower edge of the fixed portion to form a recess, wherein the free end of the securing element is confined within the recess.

20. The card edge connector of claim 19, wherein the securing element further comprises a C-shaped part for improving elasticity thereof.

21. The card edge connector of claim 19, wherein the lock element extends obliquely inward and outward from the lower edge of the flexible portion and has a base portion for engaging a bottom corner edge of the notch, wherein the base portion and the latch element limit the vertical movement of the card module.

22. The card edge connector of claim 19, wherein the flexible portion further comprises a resistance provider aligned vertically with the notch, the resistance provider has an inclined surface, which is inclined slightly inward and downward, wherein the resistance provider applies a relievable resistant upward force when an improperly inserted card module engages with the inclined surface, and causes the flexible portion to deflect while an unusually large force is applied to the inclined surface.

23. The card edge connector of claim 22, wherein a peripheral outline shape of the resistance provider corresponds substantially to a shape of the notch.

24. The card edge connector of claim 22 wherein a tip portion of the resistance provider is positioned in the corresponding notch thereof, when the card module is in the accommodation space.

25. The card edge connector of claim 19, wherein the latch element extends in a curved manner inward and downward from the upper edge of the flexible portion to form a curved surface for causing the flexible portion to deflect outward when the card module is being inserted into the accommodation space, and thence outward to form a retaining portion for engaging the top surface of the card module.

26. The card edge connector of claim 19, wherein the flexible portion further comprises a support element, which extends from the upper edge of the flexible portion and is of a right-angle Z-shaped form, for engaging a bottom side of the card module for supporting the card module in the accommodation space.

* * * * *